US006116980A

United States Patent [19]

Bauer et al.

[11] Patent Number: 6,116,980

[45] Date of Patent: Sep. 12, 2000

[54] SET OF ELEMENTS ARTICULATED TO EACH OTHER

[75] Inventors: Jean Bauer, Auvernier; Jean-Philippe Lebet, Les Geneveys-sur-Coffrane, both of Switzerland

[73] Assignee: Trigam S.A., Canton of Neuchatel, Switzerland

[21] Appl. No.: 08/808,006

[22] Filed: Mar. 3, 1997

Related U.S. Application Data

[63] Continuation of application No. 08/438,775, May 11, 1995, abandoned.

[30] Foreign Application Priority Data

May 17, 1994 [CH] Switzerland ..... 1.522/94

[51] Int. Cl.[7] ..... A63H 33/08

[52] U.S. Cl. ..... 446/104; 446/115; 446/116; 446/120

[58] Field of Search ..... 446/102, 104, 446/108, 115, 116, 120, 121; 273/156, 153 P

[56] References Cited

U.S. PATENT DOCUMENTS

| | | | |
|---|---|---|---|
| 2,776,521 | 1/1957 | Zimmerman | 445/116 |
| 2,814,159 | 10/1957 | Green | 446/125 |
| 4,055,019 | 10/1977 | Harvey | 446/115 |
| 4,090,322 | 5/1978 | Hake | 446/104 |
| 4,731,041 | 3/1988 | Ziegler | 446/102 |
| 4,792,319 | 12/1988 | Svagerko | 446/104 |
| 4,874,341 | 10/1989 | Ziegler | 446/125 |
| 5,100,358 | 3/1992 | Volgger | 446/104 |
| 5,183,430 | 2/1993 | Swann | 446/104 |

FOREIGN PATENT DOCUMENTS

| | | | |
|---|---|---|---|
| 108903 | 2/1968 | Denmark | 446/115 |
| 121433 | 10/1984 | European Pat. Off. | 446/120 |

*Primary Examiner*—Robert A. Hafer
*Assistant Examiner*—Jeffrey D. Carlson
*Attorney, Agent, or Firm*—Davis and Bujold

[57] ABSTRACT

Four elements are each provided with protrusions constituted by forks, the branches of which are resilient. Each fork is provided with a recess and with an embossment. The protrusions engage with each other, their embossments and their recesses hooking each other, and are thus assembled to each other around rotation axes. The series of protrusions and of the free spaces which separate them are arranged in such a way that the four elements can be articulated to each other two by two, that has for consequence they can be assembled together by engagement of the protrusions of any one element with those of another element. The protrusions on respective halves of each element are not arranged symmetrically, but they can be identical.

14 Claims, 15 Drawing Sheets

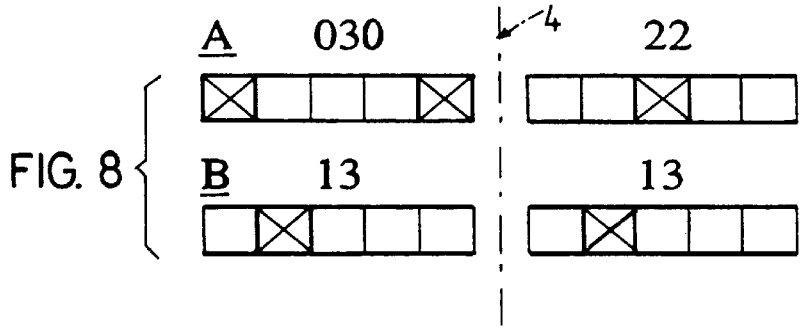
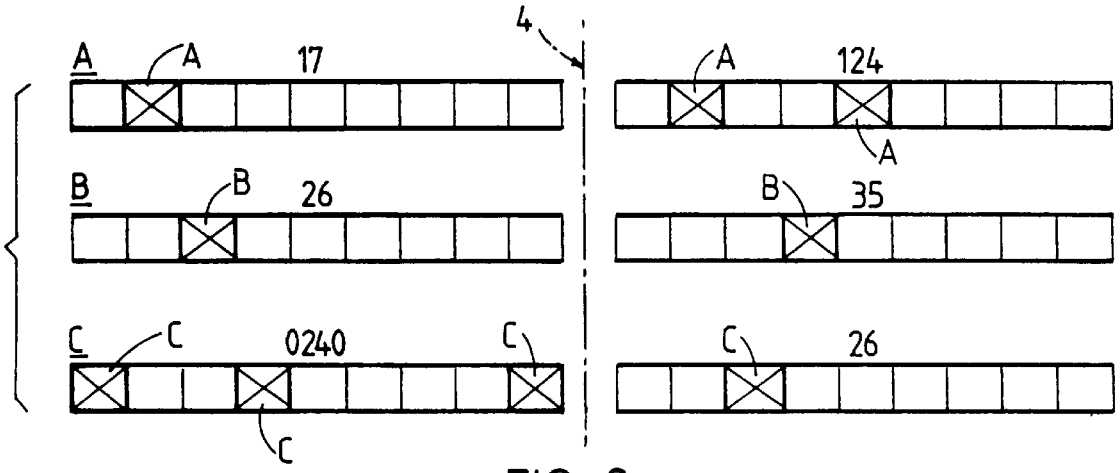
FIG. 9
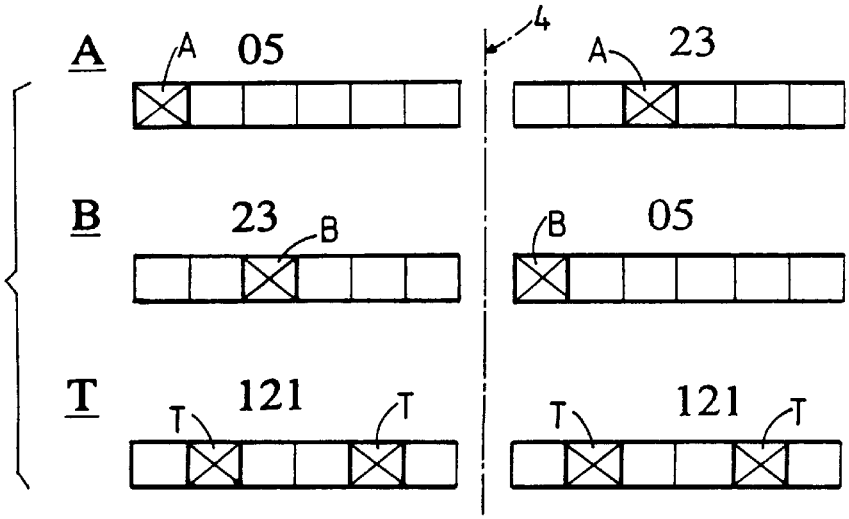
FIG. 10

SET OF ELEMENTS ARTICULATED TO EACH OTHER

This application is a continuation of application Ser. No. 08/438,775 filed on May 11, 1995 abandoned.

BACKGROUND OF THE INVENTION a) Field of the Invention

This invention relates to a set of elements, each presenting at least one rectilinear edge along which the said elements are articulated to each other by means of protrusions provided on the said rectilinear edges, which protrusions intermesh with each other.

A set of elements articulated to each other such as mentioned hereabove can be used for many diverses applications: toys, construction of scaled models, furniture such as shelves and bookcases, or structures of larger dimensions such as show-booths for example. The application to toys constitutes, however, in the present case, the main object of the invention. In this case, the elements can be constituted by polygonal plates, mostly triangles which, articulated to each other, will permit the construction of pyramids or polyhedrons. Such polyhedrons can be connected to each other along their edges, thus permitting assembly with other polyhedrons. As a result of the multiple articulations, the polyhedrons which are realized can also be provided with internal walls. The faces of the polyhedrons, as well as their internal walls, may be provided with openings so that the elements could be used in a game involving release of spherical bodies, or of other shape bodies, through such openings, or to secure to the elements complementary members, according to specific rules. If the elements of the toy are provided with figurative or symbolic patterns, their set could constitute spatial, three dimensional puzzles, with resultant supplementary interest to conventional puzzles which are positioned in a plane.

As a matter of fact, the number of the applications of such a set of elements articulated to each other, even restricted to toys, is tremendously high.

b) Description of the Prior Art

It is to be noted that it is already known to articulate elements to each other, even in the field of toys, by means of protrusions provided on a rectilinear edge of each element. However, in the known realizations, on the one hand one cannot connect more than two elements by keeping the character of an articulation, the elements being then merely assembled and not articulated, and, on the other hand, when there are more than two elements, their connection can be obtained only by means of one of the elements, which constitutes an intermediate connecting member, without all the elements of the set, whatever they can be, can be articulated, by pairs, two by two.

SUMMARY OF THE INVENTION

The object of the present invention is to provide a solution to this problem.

This object is achieved by the fact that the protrusions of the elements engage in each other.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be used and structural changes may be made as desired by those skilled in the art without departing from the present invention and the purview of the appended claims.

BRIEF DESCRIPTION OF THE DRAWINGS

FIG. 8 shows diagrammatically two shorter series of protrusions permitting any articulation of four plates in groups of three.

FIG. 9 shows diagrammatically three series of protrusions permitting eight articulations of six plates, in groups of two among which fifteen are theoretically possible, but with many more positions.

FIG. 10 is a diagrammatic representation of a series of protrusions of a modification.

DESCRIPTION OF THE PREFERRED EMBODIMENTS

Figure 1:
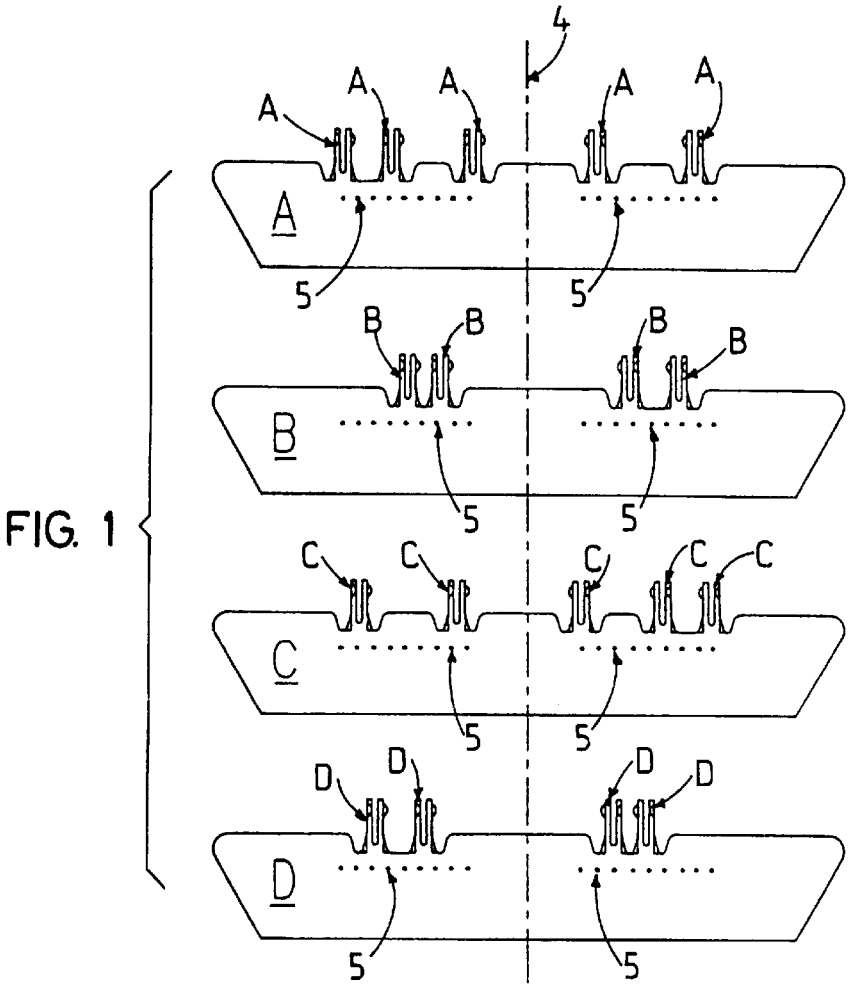
FIG. 1 shows a set of four plates able to be articulated to each other in groups of two, by pairs.

The four plates of FIG. 1, designated by references A, B, C and D, respectively, have been represented diagrammatically for illustrating the principle of the invention. They are able to be articulated to each other in groups of two or in units of two pieces, by pairs, and consequently are able to be articulated all four to each other.

It is to be noted that, physically, the plates A and C are identical, but shown in the drawing turned over recto-verso one with respect to the other. One will say they are symmetrical one with respect to each other. It is the same for the plates B and D.

Figure 4:
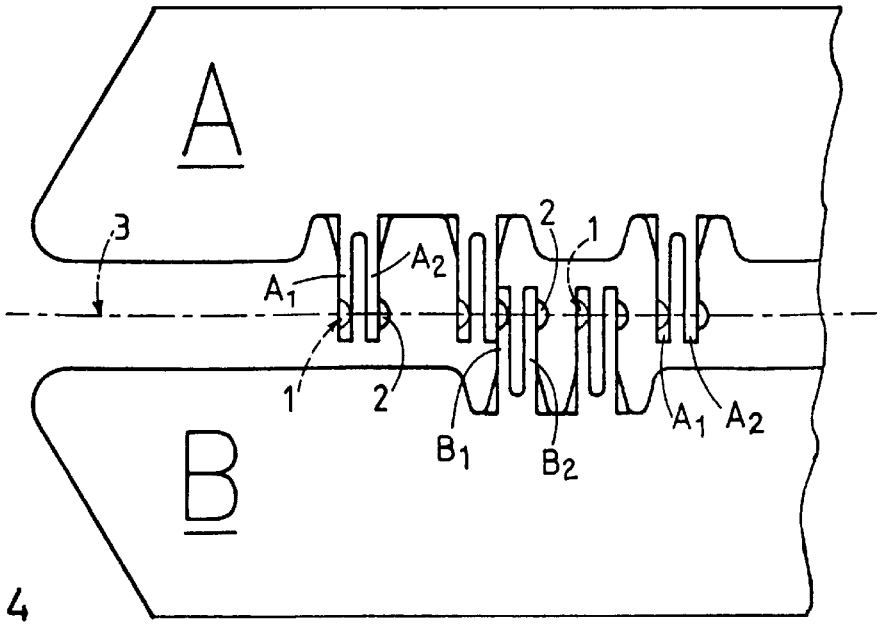
FIG. 4 is a view to an enlarged scale of a portion of the two first plates of FIG. 3 illustrating the way the protrusions thereof are hooked to each other.

One of the longitudinal rectilinear edges of these four plates is provided with protrusions designated by reference A for the plate A, by the reference B for the plate B, by the reference C for the plate C, and by the reference D for the plate D. These protrusions, which are shown on an enlarged scale in FIG. 4, are each made of a small tongue protruding on the rectilinear edge of the plate, and which is split longitudinally so that each protrusion is thus made of two branches $A_1$ and $A_2$, $B_1$ and $B_2$, $C_1$ and $C_2$, $D_1$ and $D_2$, which are resiliently deformable.

Figure 3:
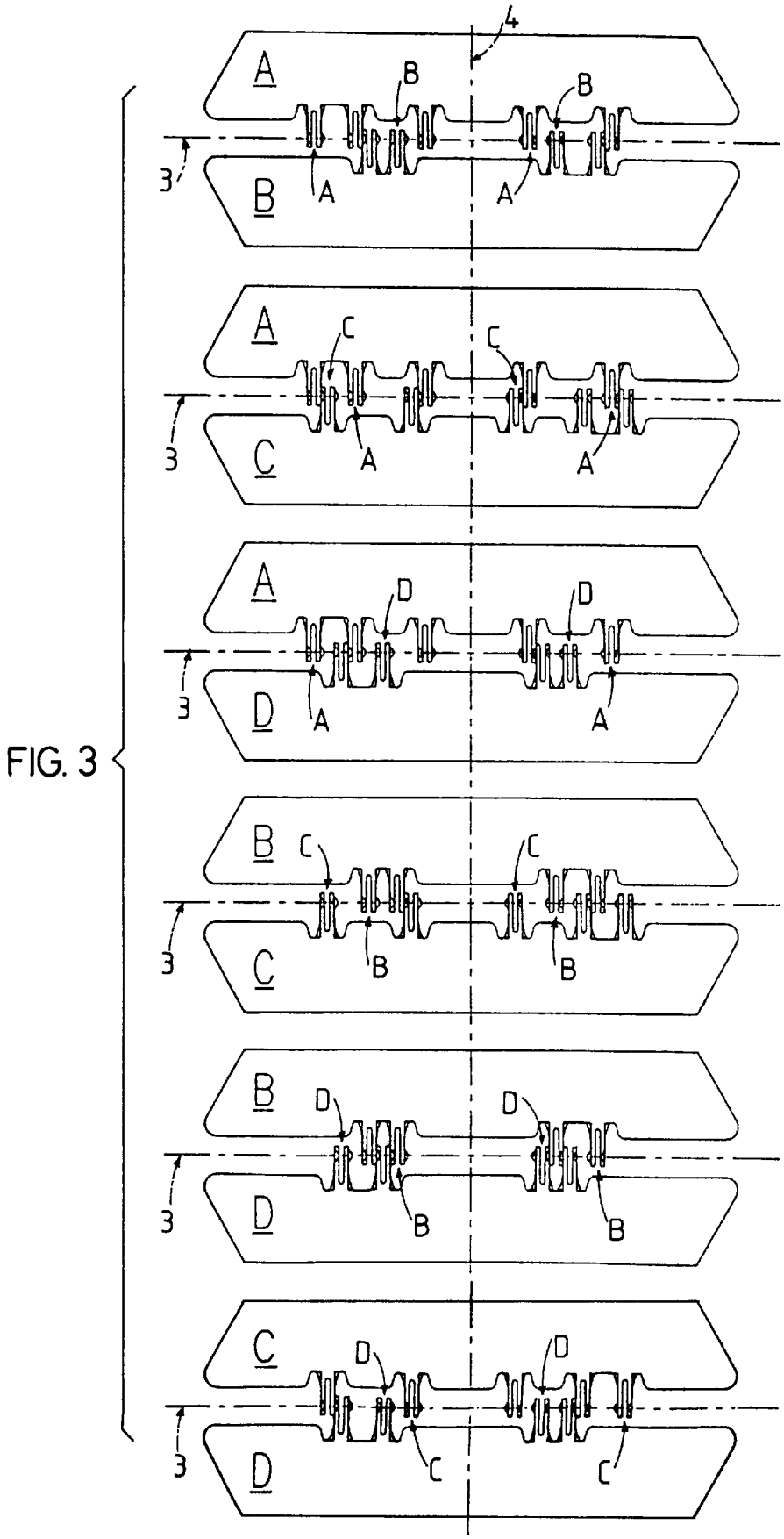
FIG. 3 shows the four plates of FIG. 1 articulated to each other in groups of two.

The branches $A_1$, $B_1$, $C_1$ and $D_1$ are each provided, on their outer lateral face, with a hemispherical recess 1, while the branches $A_2$, $B_2$, $C_2$ and $D_2$ are provided, on their outer lateral face, with a hemispherical embossment 2. When the plates are assembled to each other, by reciprocal interengagement of their protrusions with each other, the embossment 2 of each protrusion engages the recesses 1 of an adjacent protrusion, that produces the assembling, in the mode of an articulation, of the plates to each other, the axis passing through all the recesses 1 and the embossments 2, designated by 3 in FIGS. 3 and 4, constituting the axis of articulation.

The protrusions A, B, C and D are all of the same width, which width constitutes the unit of measuring of the free spaces or intervals separating the said protrusions from each other or separating the protrusions of the ends of the portions of the rectilinear edges of the plates on which said protrusions are distributed. These units of length, either occupied by protrusions or constituted by free spaces, will be called hereafter as being "positions", which have been indicated by points 5 in FIG. 1.

Figure 2:
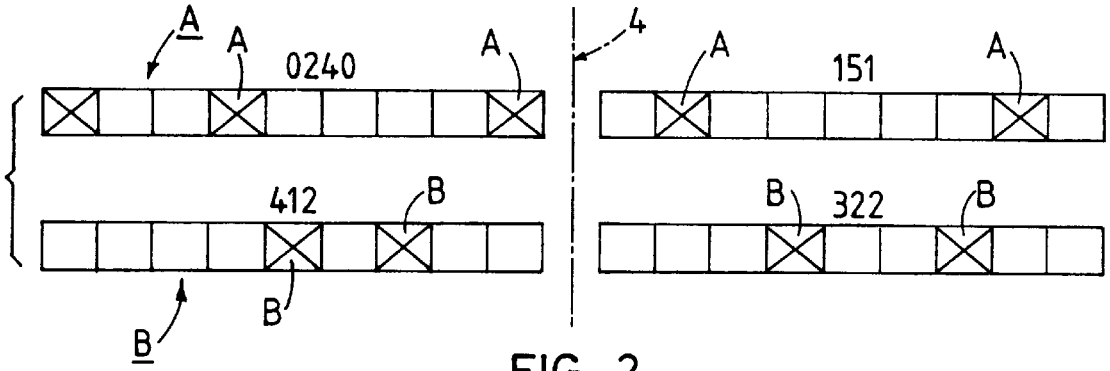
FIG. 2 is a diagrammatic representation of the series of the protrusions and of the free spaces of two of the four plates of FIG. 1.

FIG. 2 shows the series of positions on the plates A and B, the plates C and D being respectively identical, in the case of the present set of plates. One sees first that these series have eighteen positions. One sees then that they are arranged on both sides of an axis, designated by reference 4 in FIGS. 1 and 2, which passes through the middle of the rectilinear edge of the plates provided with the protrusions. One sees also that the half-series situated on both sides of the axis 4 are dissymmetrical with respect to this axis.

If one considers only the free spaces and gives thereto a data corresponding to their number, before, between or after the protrusions, one sees that the half-series of the left side of plate A, appearing in in the upper portion of FIG. 2, is expressed by 0240, while the half-series at the right side is expressed by 151, that is not symmetrical. It is the same so far as plate B is concerned, for which, as shown by the lower portion of FIG. 2, the half-series of the left side is expressed by 412 and the half-series of the right side by 322. Moreover, in the case of the plates A and B, and consequently of the plates C and D also, the two half-series situated on the both sides of the axis 4 are not only dissymmetrical, but also are different one from the other.

Figure 5:
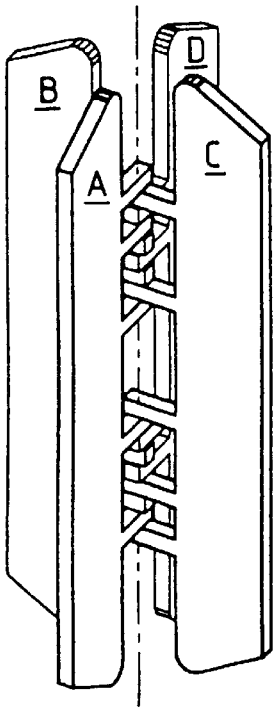
FIG. 5 is a perspective view showing the four plates of FIG. 1 articulated to each other.
Figure 6:
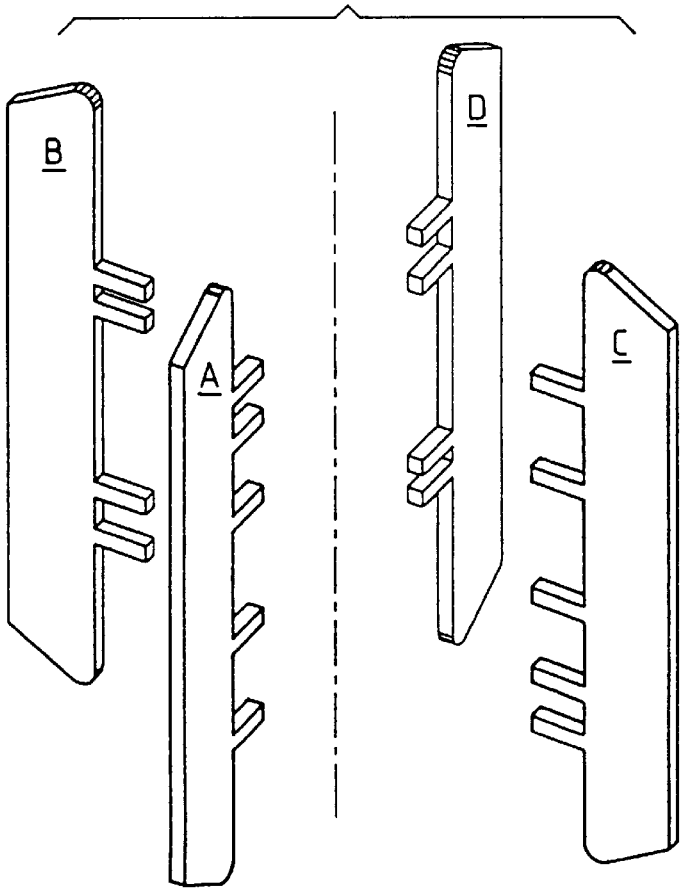
FIG. 6 is an exploded view of the four plates of FIG. 5.

FIGS. 5 and 6 show how four plates A, B, C and D can be articulated to each other.

It is to be noted that, in these figures, the protrusions A, B, C and D of these four plates have been represented diagrammatically while they are of the type represented in detail in FIG. 4.

One will also note that the disposition of the protrusions of the four plates A, B, C and D of the first embodiment is not the only one which permits assembling of four plates in groups of two, by pairs.

As a matter of fact, a general analysis of this first embodiment, i.e. a multiple articulation or hinge of four plates (N=4) permits to ascertain that several other arrangements of the protrusions can be used, the number of the positions being always, in this case, of eighteen ($P_{sym2.2}$= 18).

This number is depending from the fact that the symmetry between the plates A and C on the one hand and B and D on the other hand impells double links AC . . . CA and DB . . . BD.

These links are necessarily constituted by either two groups of three protrusions of the type ACA and BDB or a group of three protrusions+two groups of two protrusions of the type ACA and BD . . . DB or four groups of two protrusions of the type AC . . . CA and BD . . . DB for each half-series.

The symmetrical groups of two or three protrusions can be separated from each other only by an even number of protrusions (0 or 2) due to the fact that ACXBD, where X is A, B, C or D, conduces to situations which exist already, i.e. CA, BD or which have no interest, being of the type CC or BB.

Consequently, a protrusion of separation is impossible.

ACXYZBD, where X, Y, Z are A B, C or D, conduces to a similar situation with three separating protrusions, since X can be neither A, nor C, nor Z, can be neither B, nor D, nor Y and can be only on the one hand A or C or on the other hand B or D, that is impossible.

Figure 7:
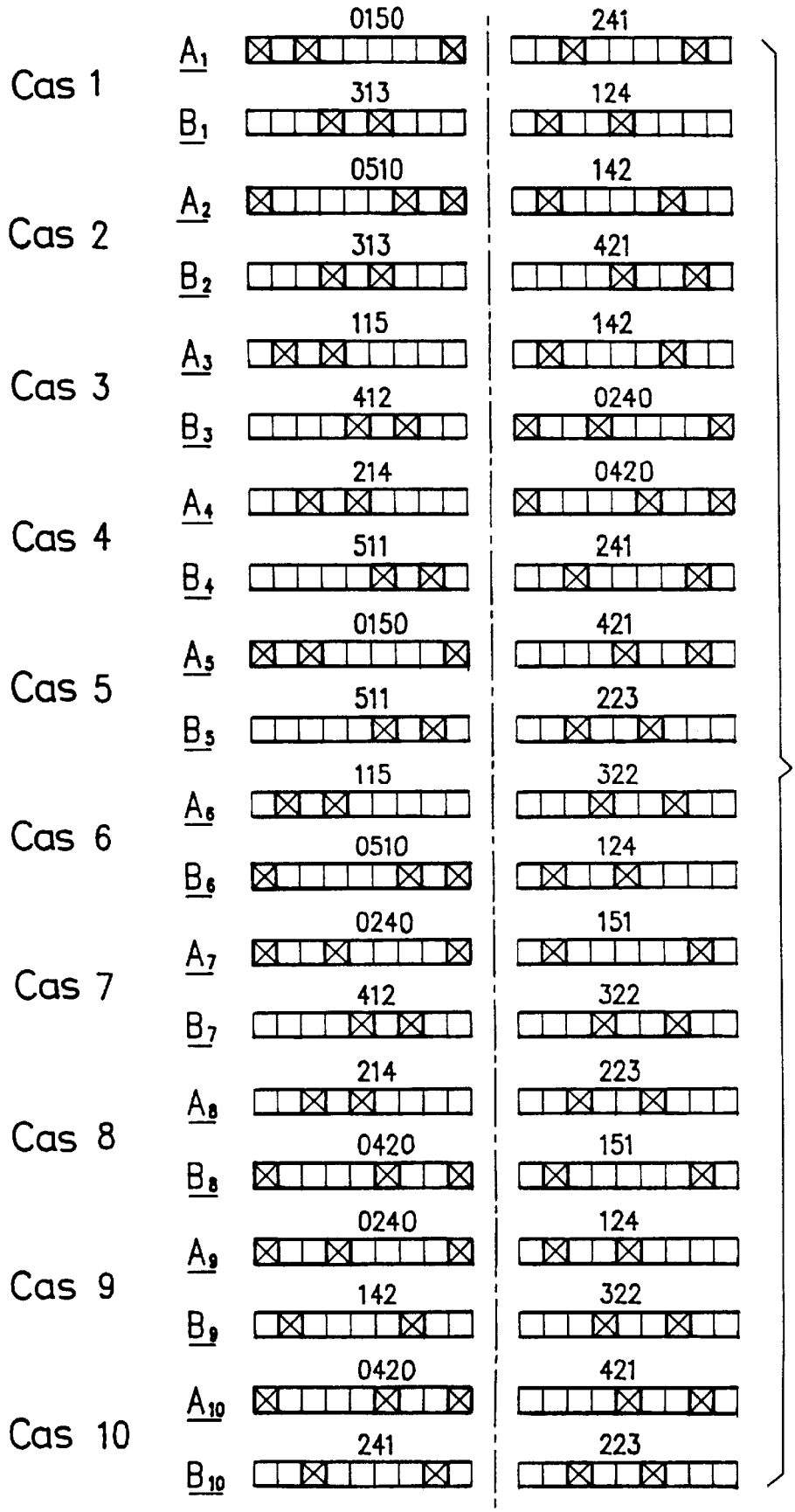
FIG. 7 is a diagrammatic representation of the series of the protrusions and of the free spaces of ten cases of four plates able to be articulated to each other in groups of two, among which Case 7 (indicated as "Cas 7") corresponds to the embodiment illustrated in FIGS. 1 to 6.

This conduces to the ten following cases, illustrated in FIG. 7, in which the series of the intervals has been indicated, as in FIG. 2, by data:

| | | |
|---|---|---|
| Case 1 | **A** C **A** **B** **D** **B** C D A | C B A **D** **B** **D** C **A** C |

It is to be noted that, in this table, the letters in the squares correspond to protrusions and that the links between the protrusions belonging to symmetrical plates have been indicated in bold characters.

One can also consider a representation under the shape of a binary table, as indicated hereunder for only the case 1, where the data "1" expresses the presence of a protrusion and the data "0" a free space. Such binary representation facilitates a mathematic or informatic treatment.

| | | | | | | | | | | | | | | | | | | |
|---|---|---|---|---|---|---|---|---|---|---|---|---|---|---|---|---|---|---|
| A | **1** | **0** | **1** | **0** | **0** | **0** | 0 | 0 | 1 | 0 | 0 | 1 | **0** | **0** | **0** | **0** | **1** | **0** |
| C | **0** | **1** | **0** | **0** | **0** | **0** | 1 | 0 | 0 | 1 | 0 | 0 | **0** | **0** | **0** | **1** | **0** | **1** |
| B | **0** | **0** | **0** | **1** | **0** | **1** | 0 | 0 | 0 | 0 | 1 | 0 | **0** | **1** | **0** | **0** | **0** | **0** |
| D | **0** | **0** | **0** | **0** | **1** | **0** | 0 | 1 | 0 | 0 | 0 | 0 | **1** | **0** | **1** | **0** | **0** | **0** |

In the cases 2, 3 and 4 hereafter indicated under the shape of tables, the missing links DC, BC, AB are realized at the left side and at the right side of the block ACADBD.

| | | |
|---|---|---|
| Case 2 | A D A **B** **D** **B** A C **A** | **C** **A** **C** **D** **B** **D** A B C |
| Case 3 | D **A** C **A** **B** **D** **B** C D | B A **D** **B** **D** C **A** C B |
| Case 4 | C D **A** C **A** **B** **D** **B** C | A **D** **B** **D** C **A** C B A |

Concerning the two following cases (cases 5 and 6), it is to be noted that one can separate the two groups ACA and DBD only by two letters, and not by only one. As a matter of fact, while separating these two groups by only one letter X one would obtain ACA X DBD. Now, X=A or B or C or D, so that one would constitute AA or BD, BD or AC, AC or DD, all these links being without interest.

The same way, there is no interest to introduce three protrusions X, Y, Z between two groups, that would conduce to a situation similar to this one where one would introduce a protrusion X only.

| | | |
|---|---|---|
| Case 5 | **A** C **A** D C **B** **D** **B** A | C **D** **B** **D** A B C **A** C |
| Case 6 | B **A** C **A** D C **B** **D** **B** | **D** **B** **D** A B C **A** C D |
| Case 7 | **A** C D **A** **B** **D** **B** C **A** | C **A** **D** **B** **D** C B **A** C |

This case corresponds to the embodiment of FIGS. 1 to 6.

In the present case, the half-series is obtained from the half-series of the case 5 while moving merely the link AC from the extreme left side to the extreme right side.

| | | |
|---|---|---|
| Case 8 | **B** **D** **A** C **A** B C **D** **B** | **D** **B** A D C **A** C **B** **D** |

The half-series of this case is obtained from the half-series of case 6 while displacing merely the link BD of the extreme right side to the extreme left side.

One could also consider that the groups ACA and BDB are separated for constituting AC . . . CA and DB . . . BD. There are then two ways of placing them which constitute the cases 9 and 10.

| | | |
|---|---|---|
| Case 9 | A **B** **D** **A** C **D** **B** C **A** | C **A** **D** **B** **A** C **B** **D** C |
| Case 10 | **A** C **B** **D** C **A** **D** **B** A | C **D** **B** C **A** **B** **D** **A** C |

The half-series of case 10 is obtained from the half-series of case 9 while displacing the ninth protrusion, which is "isolated" from the extreme left side to the extreme right side.

It is to be noted that it is not possible to intercalate this ninth protrusion between the four groups of two symmetrical protrusions, since one then would have either a repetition of protrusions or a repetition of groups of two symmetrical protrusions.

Formally, it is always possible to permute the names of the protrusions. For instance A with C or B with D, or even AC with BD, since it is a matter of arbitrarily designating the plates and the series of protrusions with which they are provided; physically, this does not constitute modifications.

These ten cases have been illustrated diagrammatically in FIG. 7 (each one indicated as "Cas") which is similar to FIG. 2 of the first embodiment. In this figure, the designations A and B of the plates have been provided with a numbered index corresponding to the illustrated cases.

Incidentally, case 7 of FIG. 7 corresponds to the first embodiment (FIG. 2).

In the ten cases of FIG. 7, one sees that two series of protrusions are sufficient in each case, the two other series being superposable by turning over.

Five protrusions in one of the series or four in the other one are necessary. Consequently, the eighteen positions are all occupied.

The analysis of the intervals on each of the ten cases shows that the sum of the intervals of the two series is equal to 27 units. This amount of 27 is constituted by $3\times7+1\times6$ while considering the half-series. In the case 1, for instance, the sum of the intervals of the half-series at the left side of A is of six positions and the one of the half-series at the right side is of seven positions, while the sum of the intervals of the half-series at the left side of B is of seven positions as well as the one of the right side.

One finds, in each of these ten cases, a series which starts with an end protrusion.

In none of the series or half-series are there adjacent protrusions so that there is no "0" in a half-series.

When the protrusions are in the number of three and when two of them are situated at the ends of the half-series, the sum of the intervals of the half-series is worth six positions. Hence, the interval which is the longer is of five positions.

It is not possible for there to be two intervals of three units which are adjacent, either 331, 133, or 033. This would necessitate unavoidable double links so that other ones would fail. Thus, necessarily, such cases are excluded. On the other hand, the half-series "313" is possible (see cases 1 and 2 of FIG. 7).

One ascertains that, in these ten cases only one space is worth 0 two to four spaces are worth 1 two to five spaces are worth 2 from zero to two spaces are worth 3 one to three spaces are worth 4 from 0 to two spaces are worth 5

In other words, there is always one space worth 0, at least two spaces worth 1, at least two spaces worth 2, at least one space worth 4 and at least one space worth 3 or 5.

The choice from one or the other of cases 1 to 10 hereabove mentioned can depend from the resistance of the assembling or from the mechanical torque necessary to separate two plates.

One will speak from torque when the separation of the plates from each other will be effected by torsion around an axis which is perpendicular to the plane of the two assembled plates disposed, for the operation, in the prolongation from another. The evaluation of the resistance to the torsion can be effected while considering cases 1 to 10 hereabove mentioned.

If one admits a pulling out force f which is constant for each pair of protrusions engaging with each other, the torsion torque or moment M necessary for separating two assembled plates calculated with respect to the median axis 4 will be the following $$|M_{xy}| = f \cdot d_{xy} + f \cdot d_{yx}$$

$d_{xy}$ being the distance between the axis 4 and any connection, generally called XY.

Obviously, if there is a double connection, the moment M is the sum of both.

The maximum difference between the extreme torques, the average torque and the minimum torque has been indicated in front of each table of cases 1 to 10 taken from FIG. 7. The detail of the calculation of the torques has been indicated for the case 7 due to the fact that it constitutes the most favorable case.

Case 1 | A | C | A | B | D | B | C | D | A | C | B | A | D | B | D | C | A | C |

Maximum difference 26f, average torque 12f, minimum torque 4f

Case 2 | A | D | A | B | D | B | A | C | A | C | A | C | D | B | D | A | B | C |

Maximum difference 12f, average torque 12f, minimum torque 6f

Case 3 | D | A | C | A | B | D | B | C | D | B | A | D | B | D | C | A | C | B |

Maximum difference 20f, average torque 12f, minimum torque 6f

Case 4 | C | D | A | C | A | B | D | B | C | A | D | B | D | C | A | C | B | A |

Maximum difference 14f, average torque 12f, minimum torque 8f

Case 5 | A | C | A | D | C | B | D | B | A | C | D | B | D | A | B | C | A | C |

Maximum difference 24f, average torque 12f, minimum torque 6f

Case 6 | B | A | C | A | D | C | B | D | B | D | B | D | A | B | C | A | C | D |

Maximum difference 20f, average torque 12f, minimum torque 6f

-continued

Case 7 | A | C | D | A | B | D | B | C | A | C | A | D | B | D | C | B | A | C |

Maximum difference 10f, average torque 12f, minimum torque 8f $M_{AC} = f * (8 + 1 + 1 + 8) = 18f$
$M_{BD} = f * (3 + 4 + 4 + 3) = 14f$
$M_{AB} = f * (7 + 5) = 12f$
$M_{AD} = f * (2 + 6) = 8f$
$M_{CD} = f * (5 + 7) = 12f$
$M_{BC} = f * (6 + 2) = 8f$ Case 8 | B | D | A | C | A | B | C | D | B | D | B | A | D | C | A | C | B | D |

Maximum difference 16f, average torque 12f, minimum torque 6f

Case 9 | A | B | D | A | C | D | B | C | A | C | A | D | B | A | C | B | D | C |

Maximum difference 12f, average torque 12f, minimum torque 8f

Case 10 | A | C | B | D | C | A | D | B | A | C | D | B | C | A | B | D | A | C |

Maximum difference 18f, average torque 12f, minimum torque 6f

One sees that it is case 7 which is the most favourable from the mechanical point of view, since it is the one in which the difference between the extreme torques is the lowest (10 f) and almost this one for which the minimum torque is the highest (8 f). However, case 4 shows also a minimum torque of 8 f that renders it almost as favourable as case 7. It is the same for case 9 where the minimum torque is also of 8 f, the only difference lying in a maximum difference of 12 f instead of 10 f for case 7.

FIG. 8 illustrates the case of four plates two of which, indicated by A and B, are symmetrical from the two other ones, respectively, and which can be assembled in groups of three. One of the rectilinear edges of these four plates is provided with a series of protrusions, each of ten positions, each divided in two half-series, situated at the left side and at the right side of a median axis 4. FIG. 8 shows that the half-series at the left side of plate A comprises two end protrusions separated by a free space of three units, and that the half-series at the right side shows a protrusion situated in the middle, situated between two free spaces each of two units. So far as the half-series of plate B is concerned, it shows a protrusion situated at a distance of one unit from one end of the half-series and of three units from the other end. It is the same for the half-series at the right side of plate B.

It is to be noted that the notation 13,13 of FIG. 8 could suggest that there is a symmetry. However, this is not the case since, if one turns the plate over with respect to its median point, one sees that the protrusions are then placed at different places.

FIG. 9 shows the series of the protrusions of three plates A, B and C, having eighteen positions, it being understood that the set will comprise three other plates symmetrical with respect to plates A, B and C, respectively. This set will permit eight assemblings or hinges which are possible, among the fifteen assemblings in groups of two which could be theoretically possible, but with more positions.

FIG. 10 illustrates diagrammatically the case of a set of five plates three of which have been represented having twelve positions, in which two of these plates A and B are symmetrical with respect to the two other ones, respectively. The two half-series of protrusions A of plate A are expressed by 05 and 23 and the protrusions B of plate B by 23 and 05. An auxiliary plate T, the half-series of protrusions T of which are expressed by 121, are identical and symmetrical. Plate T, in combination with the four plates of the set, permits a number of four assemblings A, B, C, D with T, consequently of any assembling of the plates A, B, C and D in groups of two, with the plate T.

Figure 11:
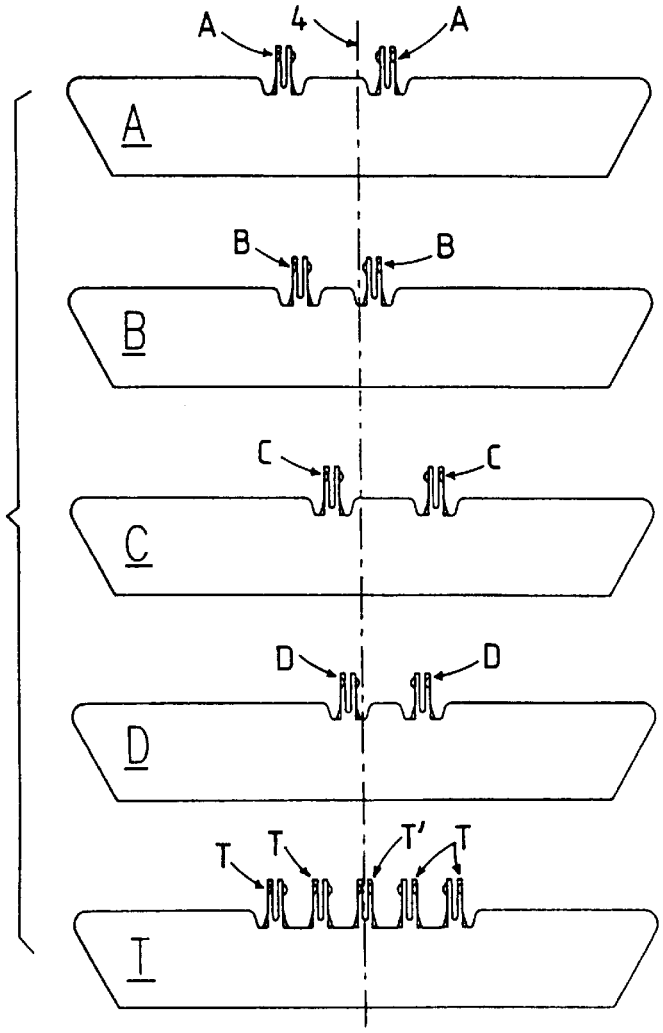
FIG. 11 shows a set of five plates able to be articulated to each other.
Figure 12:
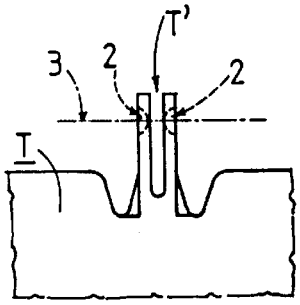
FIG. 12 is a plan view to an enlarged scale of a detail of FIG. 11.
Figure 13:
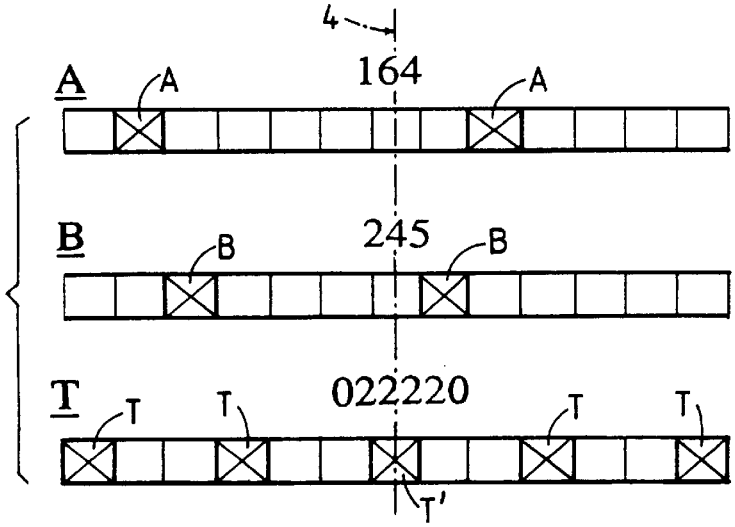
FIG. 13 is a diagrammatic representation of the series of protrusions of three of the five plates of FIG. 11.

So far as FIGS. 11 to 13 are concerned, they illustrate still another case of a set of four plates A, B, C or D, of thirteen positions, the plates C and D of which are symmetrical with respect to plates A and B, respectively, to which is added an auxiliary plate T. The plate T is provided with two half-series of protrusions T situated on both sides on the median axis 4 and moreover with a central protrusion T', represented on an enlarged scale in FIG. 12, situated on this axis, which distinguishes from the other protrusions by the fact that its resilient branches do not include a recess and an embossment, as in all the preceeding cases, but with two recesses 2. The whole series of protrusions of plate T can be expressed by 022220 as indicated by FIG. 13. Consequently, this auxiliary plate is the only one which is symmetrical and the following assemblings are possible: AT, BT, CT, DT, A B, CD and consequently also any assembling of two plates A, B, C and D in groups of two, with plate T.

The two recesses 2 of protrusion T' could be replaced by two embossments.

Figure 14:
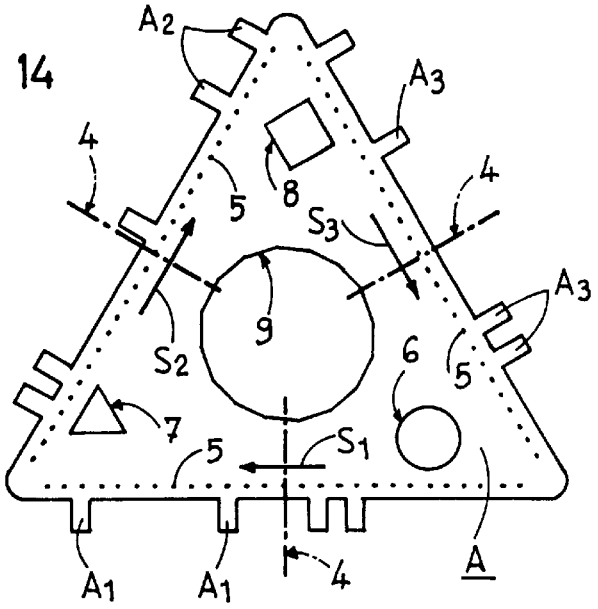
FIG. 14 shows a plate made of an equilateral triangle belonging to a set of identical plates.

The plate represented in FIG. 14, designated by A, belongs to a set of identical plates. It is constituted by an equilateral triangle, the three edges of which are provided with a series of protrusions of twenty-six positions indicated by points 5. The said series is represented symbolically by three arrows $S_1$, $S_2$ and $S_3$. The protrusions of said three series are represented diagrammatically by $A_1$, $A_2$ and $A_3$, respectively. The middle point of these three series is indicated by an axis 4 for each of them. Plate A is provided with three holes 6, 7 and 8, of different shapes, permitting to identify these series, whatever may be the face of the plate which is observed.

Plate A is intended to be used either in the position represented in FIG. 14, or turned over on itself, recto-verso.

Figure 15:
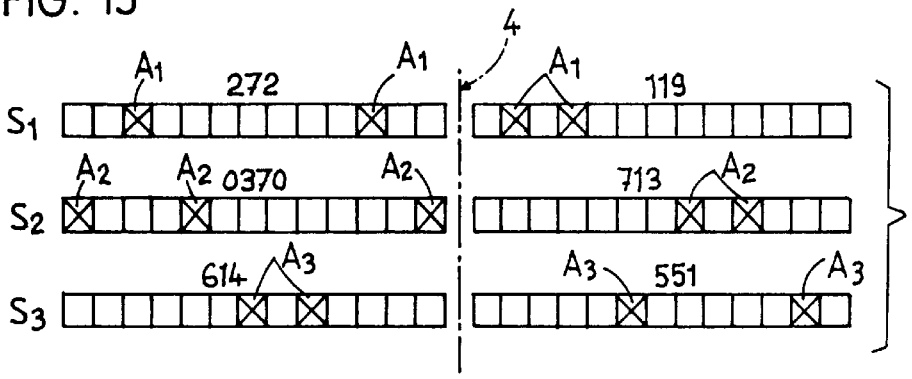
FIG. 15 is a diagrammatic representation of the series of the protrusions and of the free spaces of the three edges of the triangular plate represented in FIG. 14.

The three half-series of the series of protrusions $S_1$, $S_2$ and $S_3$ are represented diagrammatically in FIG. 15 and are expressed, as previously, by data, i.e. 272 for the first half-series of $S_1$, 119 for the second one, 0370 for the first half-series of $S_2$, 713 for the second one, 614 for the first half-series of $S_3$, 551 for the second one.

Figure 16:
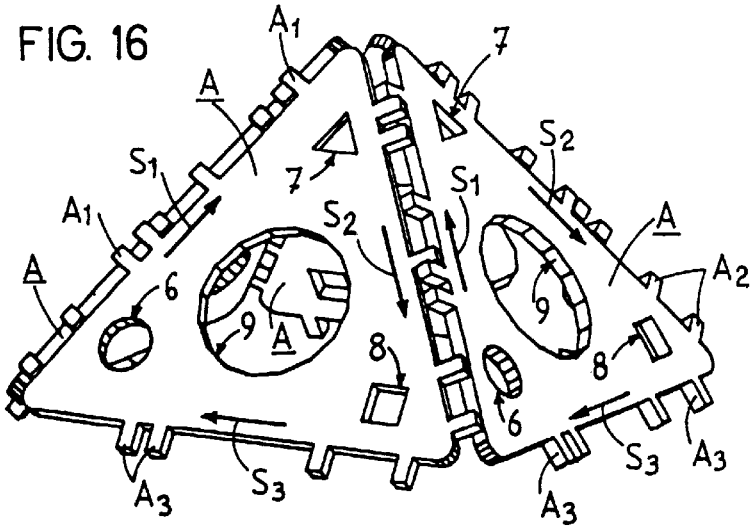
FIG. 16 is a perspective view of a pyramid having a square base constituted of four plates such as the one represented in FIG. 14.
Figure 17:
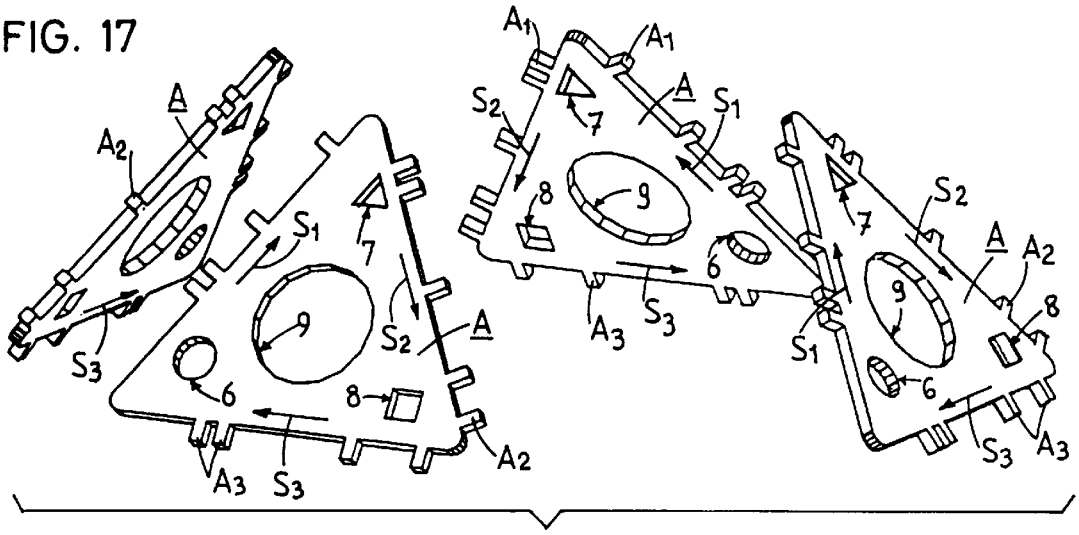
FIG. 17 is an exploded view of the pyramid shown in FIG. 16, to an enlarged scale.
Figure 18:
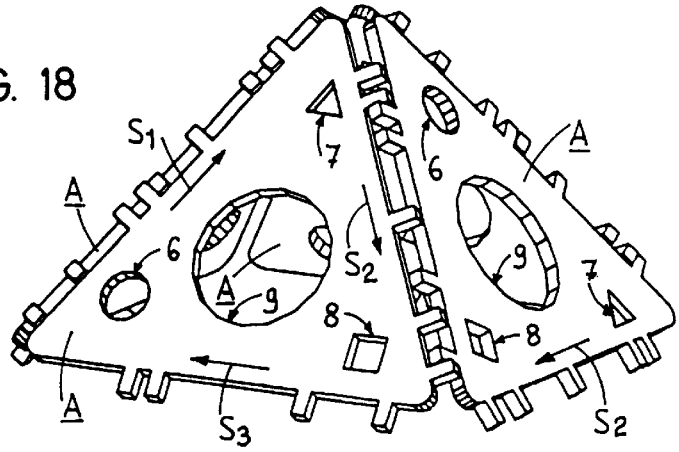
FIG. 18 is a perspective view of a pyramid having a square base constituted of four plates such the one represented in FIG. 14, but arranged in a way which is different from that of FIG. 16.

A set of triangular plates A like the one represented in FIG. 14 can be used for the realization of a pyramid having a square base such as the one represented in FIG. 16 or the one of FIG. 18.

In the case of FIG. 16, the four triangular plates A constituting the pyramid, the base of which is not concretized but which could be by a square plate, have all a same face turned to the outside or to the inside, that is to say that none of them is turned over recto-verso. Moreover, they are all oriented the same way, the edge of each plate constituting the base being constituted by the series $S_3$.

Figure 19:
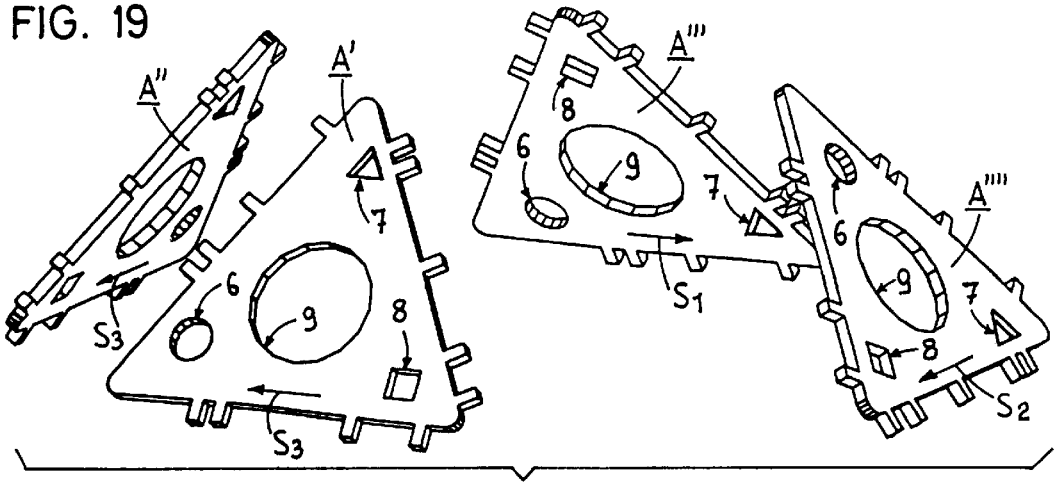
FIG. 19 is an exploded view of the pyramid shown in FIG. 18, to an enlarged scale.

In the case of the pyramid of FIG. 18, on the contrary, plates A are all turned the same way but in different orientations. Thus, the basis edge of the pyramid is constituted by the series $S_3$ so far as the front plate, designated by A' is concerned, also by $S_3$ so far as the left side plate of FIG. 19, designated by A",is concerned, by $S_1$ for the rear plate, designated by A'", and by $S_2$ for the right side plate of FIG. 19, designated by A"".

Figure 20:
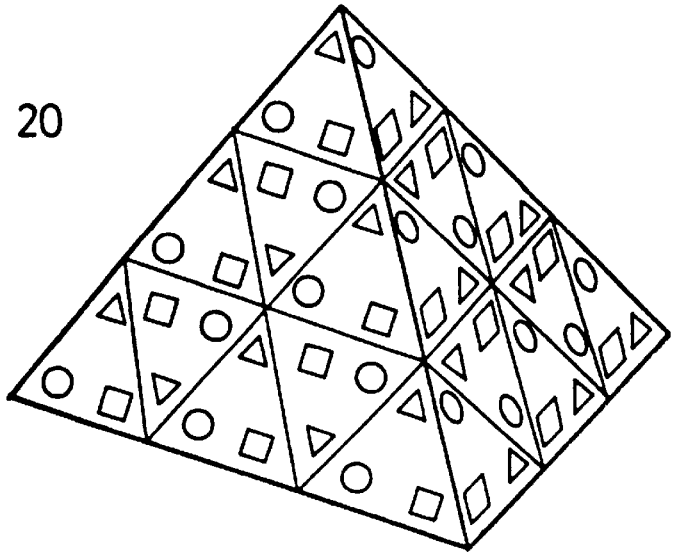
FIG. 20 is a perspective view of a pyramid constituted by a group of pyramids such as the one represented in FIG. 18, to a smaller scale than that of FIGS. 16 and 18.
Figure 21:
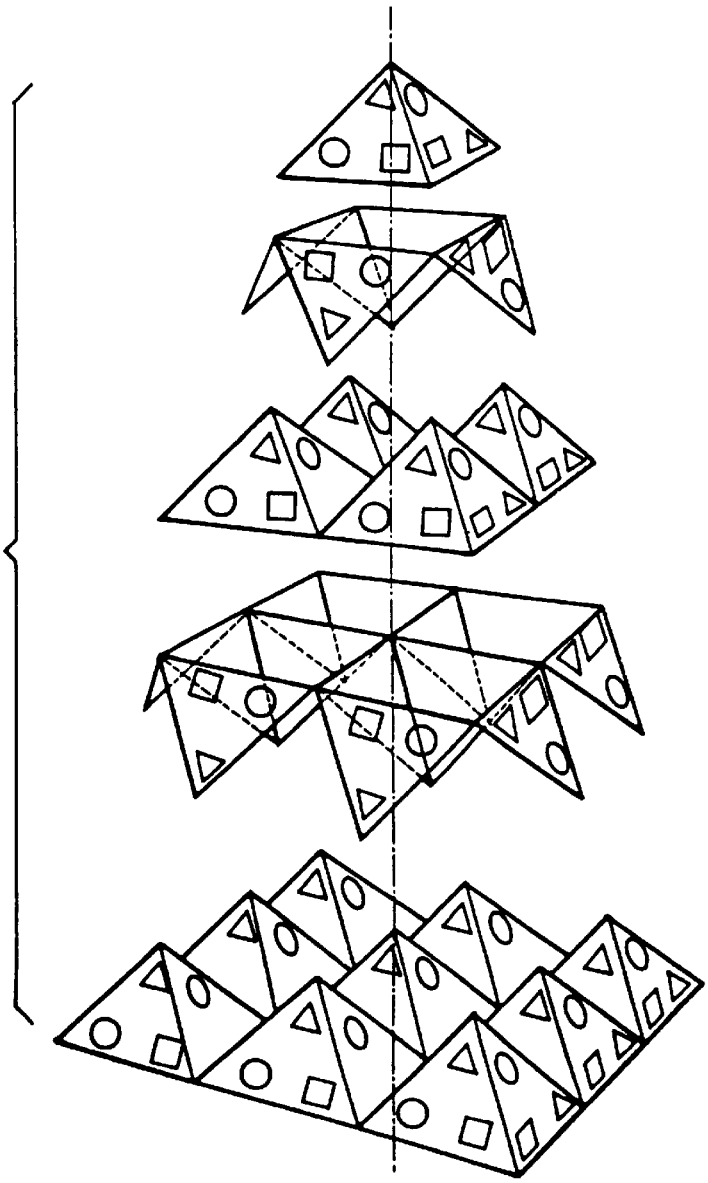
FIG. 21 is an exploded view of the pyramid of FIG. 20.

One could, still by means of plates identical to plate A of FIG. 14, realize not only pyramids of the type of those shown in FIGS. 16 or 18, but also pyramids having multiple layers, such as that shown in FIGS. 20 and 21 in which the central hole 9 of the plates has not been represented.

FIG. 21 is specially representative of the way the pyramid of FIG. 20 is made. This pyramid is constituted by successive layers; the first one, from the top, is constituted by a pyramid like pyramid of FIG. 18, the third one by four identical pyramids which are juxtaposed and the fifth one by nine identical pyramids which are juxtaposed.

So far as the even layers are concerned, they are constituted by identical pyramids but turned over, one for the second layer and four for the fourth layer and, moreover, by complementary triangular plates A constituting closing shutters.

The number of layers, always uneven, could be higher than five, which is the case of the example disclosed and represented.

One realizes this way, innerly walled pyramids which could, if the triangular plates A are provided with patterns, constitute a tridimensional puzzle. The same way, if the plates A are provided with a central hole such as the hole designated by reference 9 in FIG. 14, also represented in FIGS. 16 to 19, the plates A could serve to the realization of innerly walled solids permitting to play a game consisting in passing members through the holes of the inner walls of the solid or to secure a member provided with a special pattern, for instance a graphic symbol, a data or a letter (removable in this case, but which could also be printed directly on the plate).

Figure 22:
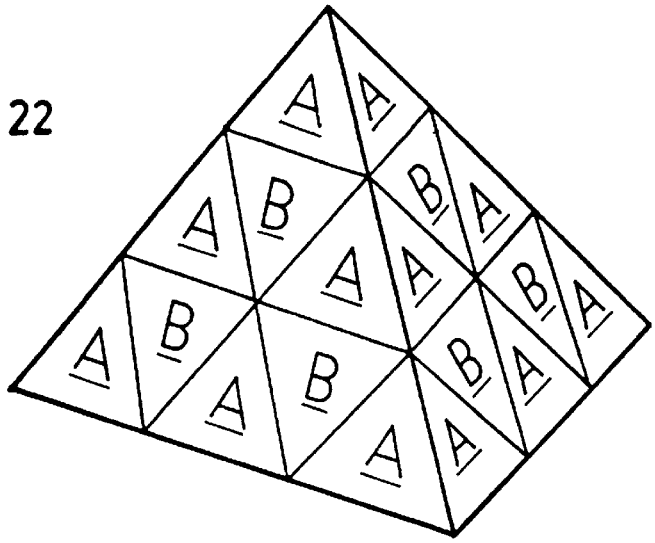
FIGS. 22 and 23 are views similar to the ones of FIGS. 20 and 21, respectively, of a modification of a pyramid.
Figure 23:
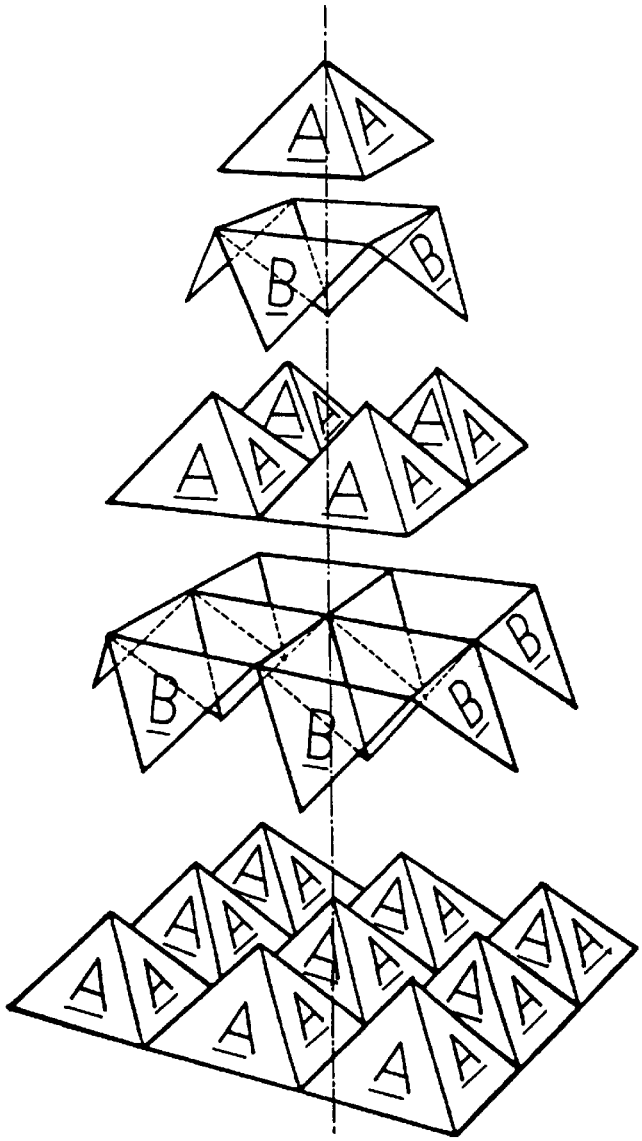

One could realize pyramids which are similar to the one represented in FIGS. 16 and 18, such as the pyramid of FIGS. 22 and 23, while using plates A and B of two different types, having the shape of equilateral triangles. The plates of the two types will present, on their three sides, series of identical protrusions, but different for each of the said two types.

It is to be noted that multi-layers tetrahedrons can be realized the same way as the pyramids, so far as they are cut along planes the angle of which is chosen in such a way that one finds the same conditions as those of the pyramid.

Generally speaking, pavements at two dimensions, plan or in relief, also polyhedrons, can be realized with polygons provided with only one series A or with only a series B. These pavements realize interengagements of the type AC or respectively BD, that is to say between the series A and the series A turned over, i.e. C, since the opposed sides of a polygon, if they are faced to each other, are turned over.

Obviously, a pavement of the type AC can be connected, on an open or closed periphery, by its articulations, to a pavement of the type BD. That requires that the walled structures can be realized by alternating the layers AC and BD. A pyramid can for instance be thus realized by using the two types of triangles showing, on their respective peripheries, both three identical series but different from each of these two triangles.

Figure 24:
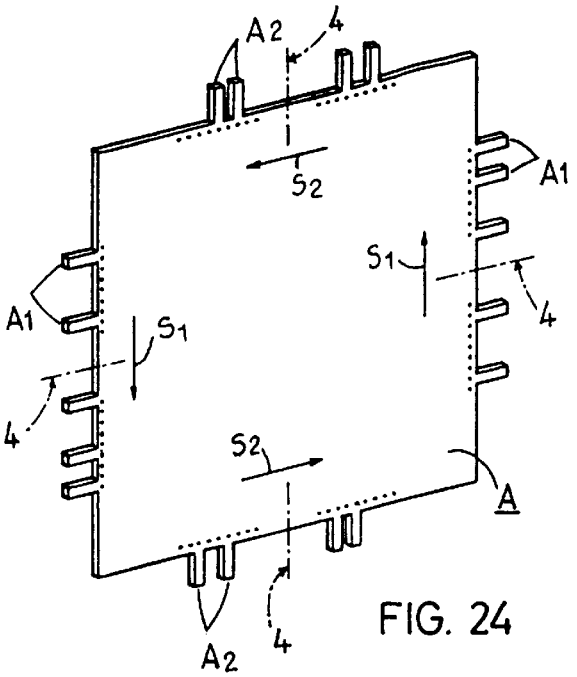
FIG. 24 is a perspective view of a square plate belonging to a set of identical plates, the series of protrusions of which are the same as the ones of the embodiment of FIGS. 1 to 6.

Different series on the periphery of the same polygon have already been considered (FIG. 14) but will appear also later (FIG. 24).

By means of the distribution of different series along the periphery of a polygon, it is possible to make choices conducing to a reduction of the number of the necessary positions, especially when these polygons serve to the realization of walled structures. Especially, as indicated hereabove, an interesting solution can be realized with twenty-six positions (see FIGS. 14 to 21); in this case, all the articulations two by two are not necessary, since they do not appear during the realization of the construction.

Generally speaking, if the number of the positions of twenty-six for a triangular plate is convenient, especially for mounting walled pyramids, this number could be different, being situated between eighteen and thirty-eight, depending on whether one is satisfied with a minimum number of two connected edges, or on the contrary if one requires that all of the edges be connected two by two, with or without a turning over of plates.

The plate represented in FIG. 24, designated by A, belongs to a set of identical plates. It is constituted by a square the four edges of which are provided with series $S_1$ and $S_2$ of protrusions, of eighteen positions. These protrusions, diagrammatically represented, are designated by $A_1$ and $A_2$ depending from the series to which they belong. The series of two opposite sides, represented diagrammatically by the arrows $S_1$ and $S_2$, are identical to those of the plates A and B of FIG. 1. They are symmetrical with respect to the axes of the square indicated at 4. When using the same notation as previously where the number of the positions of the free spaces separating the protrusions is numbered, one ascertains that the half-series at the left side of the series $S_1$ is expressed by 0240, the half-series of the right side by 151, the half-series at the left side of the series $S_2$ by 412 and the half-series at the right side by 322.

Figure 25:
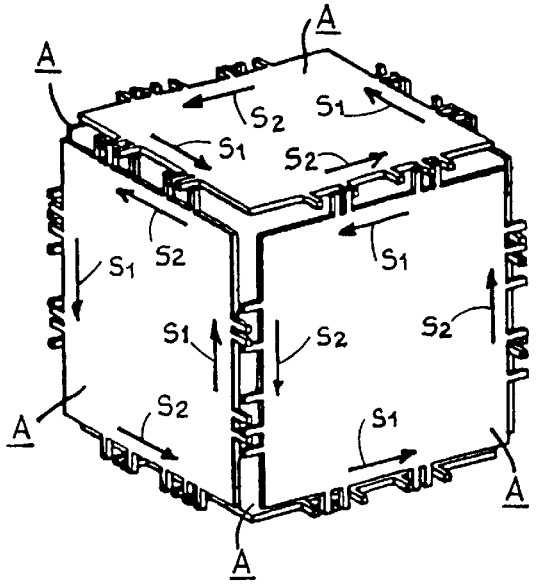
FIG. 25 is a perspective view of a cube constituted of six plates such as the one represented in FIG. 24.
Figure 26:
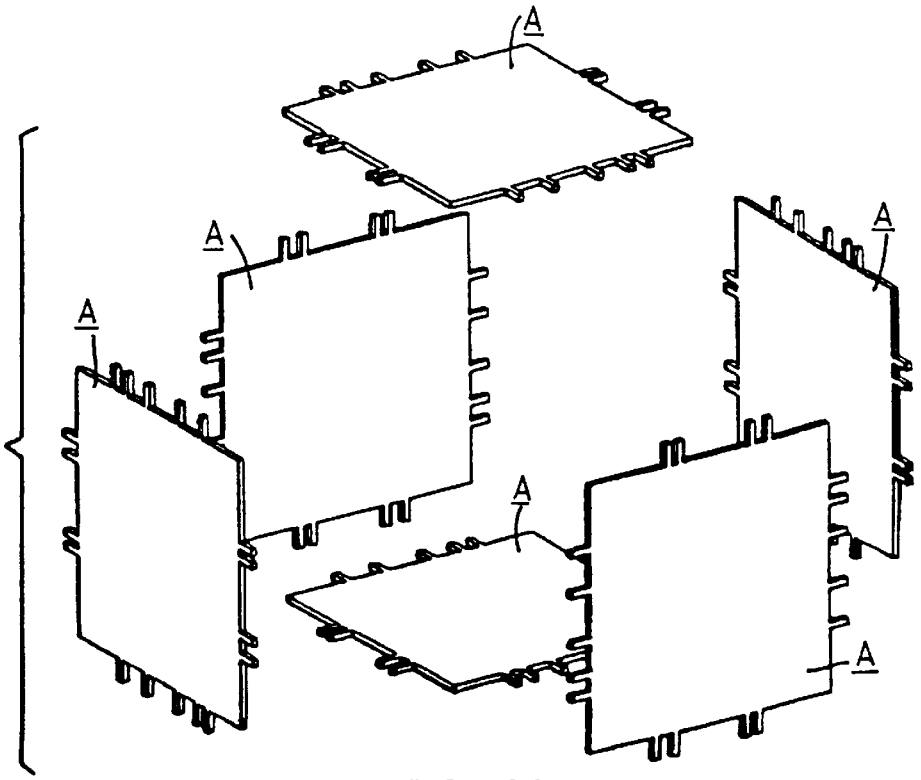
FIG. 26 is an exploded view of the cube shown in FIG. 25.

By means of six of these plates A, it is possible to realize a cube such as the one represented in FIGS. 25 and 26.

Figure 27:
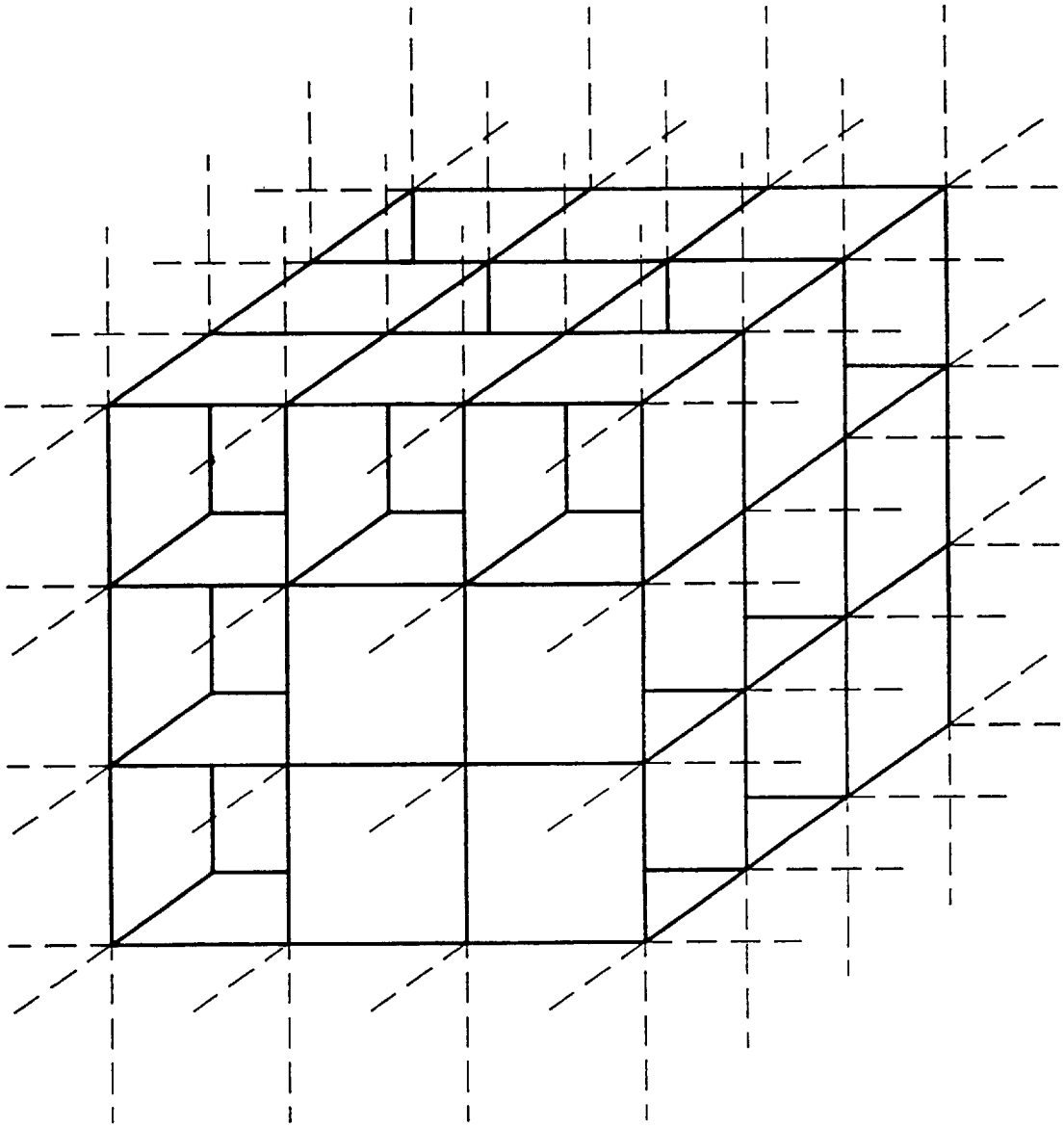
FIG. 27 is a perspective view of a portion of a cubic network constituted by identical square plates such the one of FIG. 24.

One can repeat the assembling of the plates A in such a way as to form a walled network of cubic cells, as represented in FIG. 27.

Figure 28:
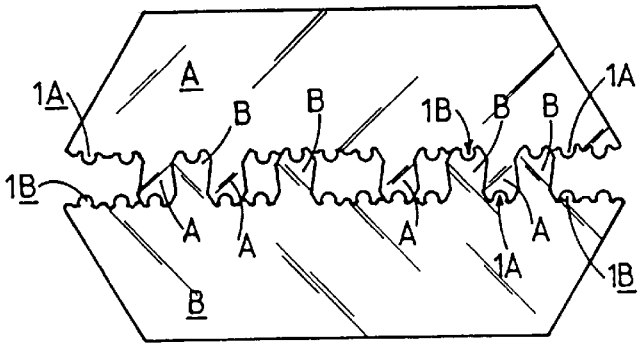
FIG. 28 shows, in a manner similar to that of FIG. 3, two plates articulated to each other, the protrusions of articulation being, however, different from those shown in the several preceeding examples.

In all of the cases which have been disclosed and represented hereabove, the protrusions for the assembling or interengagement of the plates are slotted longitudinally so as to constitute two resilient branches. In the embodiments which are disclosed hereafter, these protrusions are different and are not slotted. They show a periphery which is symmetrical with respect to their longitudinal axis. Their end is enlarged and their base is narrowed. The plates are made of resiliently deformable material so that, by deformation of this material, the interengagement of the protrusions with each other can be effected. Thus, FIG. 28 shows two plates A and B provided, respectively, with protrusions A and B.

This arrangement has the advantage, with respect to the examples which have been previously disclosed and represented, of permitting the realization of joined or contiguous series and to permit, consequently, reduction of the number of the positions which are necessary, as well as the total width occupied by two series.

Figure 30:
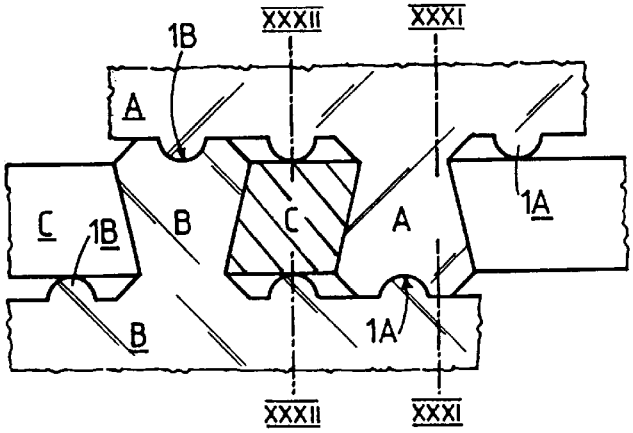
FIG. 30 shows the assembling of three plates to each other by means of protrusions of the same type as those of FIGS. 28 and 29.

Physically, the two plates A and B are identical, but represented in the drawing turned over recto-verso one with respect to each other. Consequently, they are symmetrical one with respect to each other. At each position the rectilinear edge of the plates which are provided with the protrusions show small embossments which are half-cylindrical, designated by 1A for the plate A and by 1B for the plate B. So far as the protrusions A and B are concerned, they are provided, on their front face, each with a recess 1A for the protrusions A and 1B for the protrusions B, the embossments 1A and 1B engaging the recesses 1B and 1A, respectively. This arrangement improves the rigidity of the assembly. Moreover, when more than two plates are assembled to each other, as shown for instance in FIG. 30, the embossments 1A and 1B facilitate the centering of the intermediary plate C.

Figure 29:
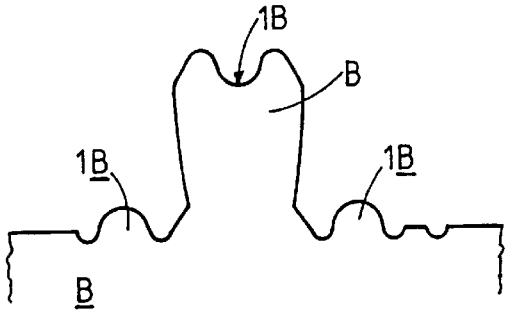
FIG. 29 is an enlarged view of a detail of FIG. 28.

In these several embodiments, the plates can intermesh while forming between each other angles different from 90°. This is the case, for example, when the plates constitute the faces of a regular pyramid or of a regular tetrahedron where they will then make angles of 109,47° and 70,53°, respectively. It is important, to this effect, that the length of the protrusions be 40% higher than their width, this width being equal to the thickness of the plate, for taking the angle into account. The profile of FIG. 29 permits as well to center plates which are perpendicular to each other as to incline them with respect to each other.

Figure 31:
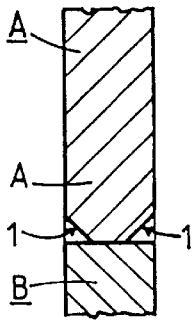
FIG. 31 is a sectional view taken along the line XXXI—XXXI of FIG. 30.
Figure 32:
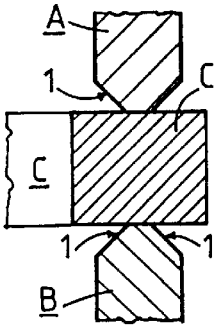
FIG. 32 is a sectional view taken along the line XXXII—XXXII of FIG. 30.

It is to be noted that bevelled edges 1 (FIGS. 31 and 32) have been provided on the plates so as to facilitate their interengagement.

Figure 33:
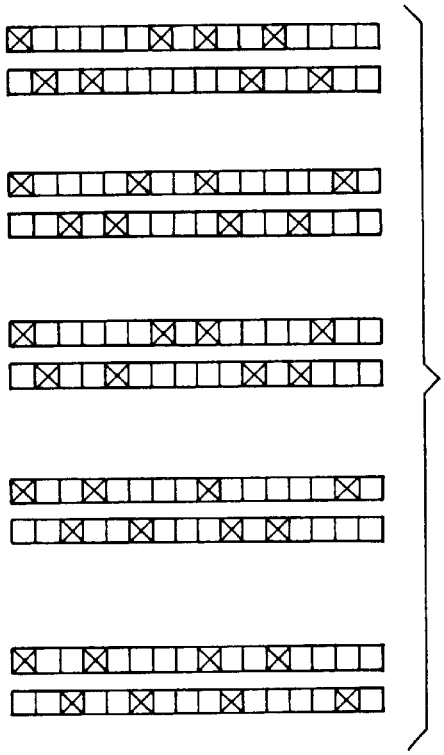
FIG. 33 is a diagrammatic representation, similar to that of FIG. 9, for instance, of the series of protrusions and of free spaces, in which the protrusions have the shape of those of FIGS. 28 to 32, applied to five cases of four plates able to be articulated in groups of two.

FIG. 33 shows the series of protrusions which are possible for sixteen positions permitting the intermeshing of four plates in groups of two, the protrusions having the shape of those of FIGS. 28 to 32.

The analysis of the mechanical torques gives the following results:

Case 1 (16)

| | |
|---|---|
| ABDBCDAC | ACBADBDC |

Maximum difference 20 f, average torque 9.3 f, minimum torque 2 f

Case 2 (16)

| | |
|---|---|
| ACBDBADC | ABCDBDAC |

Maximum difference 14 f, average torque 9.3 f, minimum torque 4 f

Case 3 (16)

| | |
|---|---|
| ABCDBDAC | ACBDBADC |

Maximum difference 12 f, average torque 9.3 f, minimum torque 2 f

Case 4 (16)

| | |
|---|---|
| ACBADBDC | ABDBCDAC |

Maximum difference 8f, average torque 9.3f, minimum torque 6f

Case 5 (16)

| | |
|---|---|
| ADBACBDC | ABDACDBC |

Maximum difference 10 f, average torque 9.3 f, minimum torque 6 f

One sees that it is case 4 which is the most favourable from the mechanical point of view, since it is the one of which the deviation between the extreme torques is the lowest (8 f) and this one for which the minimum torque is the highest (6 f). However, case 5 is alsmost as favourable, the only one difference being in the maximum deviation which is of 10 f instead of 8 f.

Figure 34:
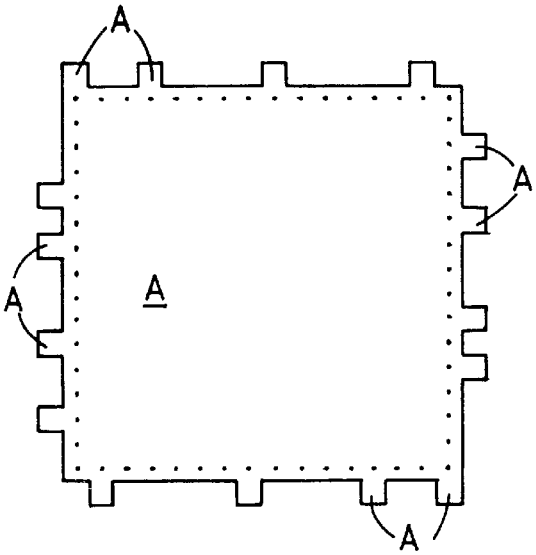
FIGS. 34 and 35 show two square plates, the first one having sixteen positions and the second one fifteen, in which the protrusions, which are diagrammatically represented, have the shape of the ones of FIGS. 28 to 32, permitting the realization of solids by interengagement of identical plates.

FIG. 34 illustrates a square plate A, the four edges of which are of sixteen positions each, the protrusions, designated by A, being represented diagrammatically while they correspond, so far as their shape is concerned, to those of FIGS. 28 to 32. The four series of these sixteen positions square are disymmetrical.

Figure 35:
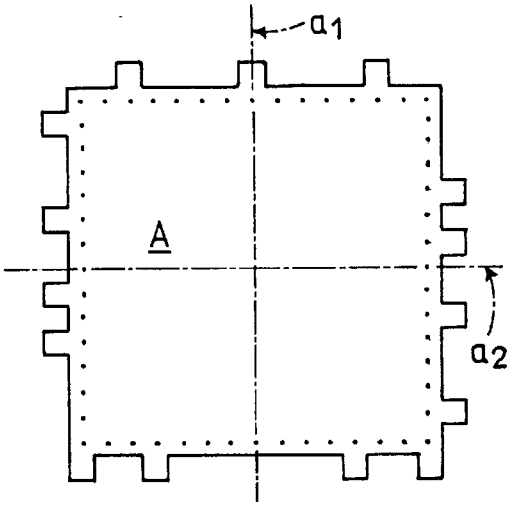
Figure 37:
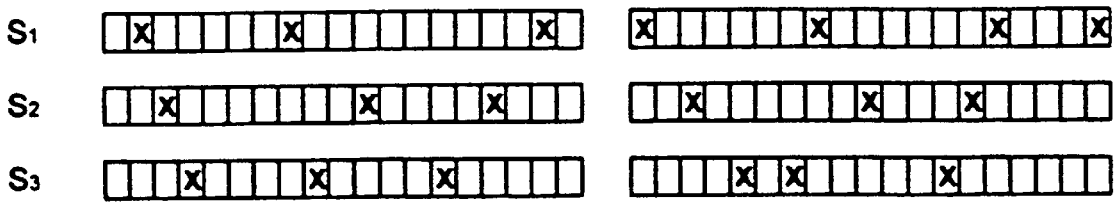
FIG. 37 is a diagrammatic representation similar to that of FIG. 33 showing 38 units.

On the contrary, in the case of the square plate A of FIG. 35, the edges of which have fifteen positions each, the series constituted by these fifteen positions are, for two of them which are opposite to each other, symmetrical with respect to the axis $a_1$ of the square while the two other ones, which are opposite to each other, are disymmetrical with respect to the axis $a_2$ of the square. However, the two series which are disymmetrical with respect to the axis $a_2$ are identical if one considers the plate viewed recto and verso.

As a modification, one could provide the case where the two symmetrical series would be of sixteen positions, provided the central protrusion of the upper edge of the plate of FIG. 35 has a double width and occupies then two positions, i.e. the positions "8" and "9".

Figure 36:
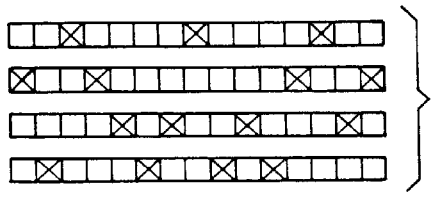
FIG. 36 is a diagrammatic representation, similar to that of FIG. 33, of a set of four plates able to be articulated in groups of two.

FIG. 36 is a diagrammatic representation of the series of protrusions and of intervals of the four assembling edges of four plates able to be interengaged in groups of two, all the four plates being identical to that shown in FIG. 35. The series of the two first lines of FIG. 36 are symmetrical while those of the two following lines are disymmetrical with respect to the middle of the edge, the two disymmetrical series being identical, the plates being observed recto and verso, respectively.

| | | | | | | | | | | | | | | |
|---|---|---|---|---|---|---|---|---|---|---|---|---|---|---|
| C | D | A | C | B | D | B | A | D | B | D | C | A | B | C |

The analysis shows that the distribution of the mechanical torques is much more homogeneous than for series which would all be symmetrical.

It is to be noted that this configuration is rather favourable from the mechanical point of view since

| | | | |
|---|---|---|---|
| AB | 0.5f + 5.5f | = 6f | |
| AC | 4.5f ± 4.5f | = 9f | |
| AD | 0.5f + 5.5f | = 6f | 8f ± 2f |
| BC | 3.5f + 6.5f | = 10f | |
| BD | 1.5f + 2.5f + 2.5f + 1.5f | = 9f | |
| CD | 6.5f + 3.5f | = 10f | |

The maximum difference is of 4 f, the average torque of 8.3 f and the minimum torque of 6 f.

It is to be noted that an assembly of only symmetrical series will give an unfavorable distribution of the mechanical torques. Thus:

| | | | | | | | | | | | | | | |
|---|---|---|---|---|---|---|---|---|---|---|---|---|---|---|
| B | A | C | D | B | C | D | A | D | C | B | D | C | A | B |

| | | |
|---|---|---|
| AB | 6.5f + 6.5f | = 13f |
| AC | 0.5f + 0.5f | = 11f |
| AD | 0.5f + 0.5f | = 1f |
| BC | 2.5f + 2.5f | = 5f |
| BD | 3.5f + 3.5f | = 7f |
| CD | 1.5f + 4.5f + 4.5f + 1.5f | = 12f |

The maximum difference is of 12 f, the average torque of 8.3 f and the minimum torque of 1 f.

The structures according to the invention could be used not only for toys, as the tridimensional puzzles, but also for the realization of scaled models or prefabricated pannels used specially in the architectural field, or even of more important constructions such as show-booths for instance.

It is to be noted that the present invention can be applied to elements the length of the rectilinear assembling edge of which is higher than the length of a series of protrusions and intervals. In other words, the length of the series is independent from the length of their supports.

In the case of elements the rectilinear edge provided with the assembling protrusions is longer than the length of a series, one can either provide an axis of symmetry in the middle of the long edge with, on both sides, a repetition of half series, or alternatively provide a repetition of complete series, this second occurrence presenting the advantage of permitting the support of the series to be cut at any point of its length.

The supports of protrusions of high length could be either rigid plates or flexible elements, made of textile, for instance, which must show, locally, a rigidity sufficient to permit the conditions of interengagement of the protrusions to remain satisfied. One could, owing to the present arrangement, carry out the turning over of pieces of texture one with respect to each other in the field of clothing, or of furniture, or others.

The assembling of such elements could be effected by means of sliding members like those of the sliding fasteners of the type called zip fasteners.

We claim:

1. A set of elements, each element comprising:

at least one rectilinear edge having a length along which the elements may be assembled with one another, each rectilinear edge including a plurality of identical protrusions formed thereon;

said protrusions being adapted to engage the protrusions on the edge of another element, said protrusions being of the same width and separated from each other along said rectilinear edge by intervals, each interval being formed of a space having at least one unit width, said unit width corresponding to the width of each protrusion, the length of said at least one rectilinear edge having a mid-point, said protrusions and said intervals being arranged along said edge disymmetrically with respect to said mid-point, each rectilinear edge having more intervals than protrusions such that at least three elements may be assembled to each other along one rectilinear edge; and wherein there are four said elements, the edges of the elements defining two series of protrusions, one of said series having four protrusions and the other of said series having five protrusions, said two series of protrusions forming four half-series of protrusions in which the intervals between the protrusions are one of:

a) two intervals of one unit width each, one interval of two units width, one interval of four units width and one interval of five units width;

b) two intervals of one unit width each, one interval of two units width and two intervals of four units width each;

c) two intervals of one unit width each, two intervals of two units width each and one interval of five units width;

d) one interval of one unit width, two intervals of two units width each, one interval of four units width and one interval of five units width; and e) three intervals of two units width each and two intervals of four units width each.

2. A set of elements as claimed in claim 1 in which the four said elements are integral, with each said element forming one side of a rectangular member, and in which the non-adjacent edges have symmetrical patterns.

3. A set of elements as claimed in claim 1 in which the four said elements are integral, with each said element forming one side of a rectangular member, and in which non-adjacent edges of each element have identical patterns.

4. A set of elements as claimed in claim 1 in which all of the elements are identical squares, each edge of said square has the protrusions formed thereon, the total number of units width of protrusions and intervals on each edge is between ten and eighteen, the protrusions and intervals define a pattern, the pattern on each edge is different from the pattern formed on at least one of the adjacent edges of the same square.

5. A set of elements as claimed in claim 1 in which all of the elements are identical squares, each edge of said square has the protrusions formed thereon, the total number of units width of protrusions and intervals on each edge is between ten and eighteen, the number of protrusions is such that the protrusions permit at least three elements to be assembled along each rectilinear edge.

6. A set of elements as claimed in claim 1 in which there are several series of intervals and protrusions which follow each other along the edge such that at least three elements may be assembled along each edge.

7. A set of elements as claimed in claim 6, wherein one of said series has between the protrusions one interval of one unit width, one interval of two units width, and one interval of five units width, and wherein the other of said series has between the protrusions one interval of one unit width, one interval of two units width, and one interval of six units width.

8. A set of elements as claimed in claim 6, wherein one of said series has between the protrusions one interval of two units width, one interval of four units width, and one interval of five units width, and wherein the other of said series has between the protrusions one interval of one unit width, one interval of two units width, and one interval of four units width.

9. A set of elements as claimed in claim 6, wherein one of said series has between the protrusions one interval of one unit width, one interval of four units width, and one interval of five units width, and wherein the other of said series has between the protrusions one interval of one unit width, one interval of two units width, and one interval of five units width.

10. A set of elements, each element comprising:

at least one rectilinear edge having a length along which the elements may be assembled with one another, each rectilinear edge including a plurality of identical protrusions formed thereon and adapted to engage the protrusions on the edge of another element;

said protrusions being of the same width and separated from each other along said rectilinear edge by intervals, each interval being formed of a space having at least one unit width, said unit width corresponding to the width of each protrusion, the length of said at least one rectilinear edge having a mid-point, said protrusions and said intervals being arranged along said edge disymmetrically with respect to said mid-point, each rectilinear edge having more intervals than protrusions such that at least three elements may be assembled to each other along one rectilinear edge;

wherein there are several series of intervals and protrusions which follow each other along the edge such that at least three elements may be assembled along each edge; and said set of elements having four such elements, the edges of the elements defining two series of protrusions comprising one of:

a) one of said two series having between the protrusions one interval of one unit width, one interval of two units width, and one interval of five units width, the other of said two series has between the protrusions one interval of one unit width, one interval of two units width, and one interval of six units width;

b) one of said two series has between the protrusions one interval of two units width, one interval of four units width, and one interval of five units width, the other of said two series has between the protrusions one interval of one unit width, one interval of two units width, and one interval of four units width; and c) one of said two series has between the protrusions one interval of one unit width, one interval of four units width, and one interval of five units width, the other of said two series has between the protrusions one interval of one unit width, one interval of two units width, and one interval of five units width.

11. A set of four elements, each element comprising:

at least one rectilinear edge having a length along which the elements may be assembled with one another, each rectilinear edge including a plurality of identical protrusions formed thereon;

said protrusions being adapted to engage the protrusions on the edge of another element, said protrusions being of the same width and separated from each other along said rectilinear edge by intervals, each interval being formed of a space having at least one unit width, said unit width corresponding to the width of each protrusion, the length of said at least one rectilinear edge having a mid-point, said protrusions and said intervals being arranged along said edge disymmetrically with respect to said mid-point;

each rectilinear edge having a length of intervals greater than a total length of said protrusions on said edge such that at least three elements may be assembled to each other along one rectilinear edge, wherein the protrusions and intervals are arranged along said edge in a pattern which permits any one of said elements to be assembled to any one of said elements along any one of said edges having a different pattern; and the edges of the elements defining two series of protrusions, one of said series having two protrusions and the other of said series having three protrusions, said two series of protrusions forming four half-series of protrusions, one of said half-series having two protrusions separated by an interval of three units width, whereby any one of said elements may be assembled with any assembly of two others of said elements.

12. A set of four elements, each element comprising:

at least one rectilinear edge having a length along which the elements may be assembled with one another, each rectilinear edge including a plurality of identical protrusions formed thereon;

said protrusions being adapted to engage the protrusions on the edge of another element, said protrusions being of the same width and separated from each other along said rectilinear edge by intervals, each interval being formed of a space having at least one unit width, said unit width corresponding to the width of each protrusion, the length of said at least one rectilinear edge having a mid-point, said protrusions and said intervals being arranged along said edge disymmetrically with respect to said mid-point;

each rectilinear edge having a length of intervals greater than a total length of said protrusions on said edge such that at least three elements may be assembled to each other along one rectilinear edge, wherein the protrusions and intervals are arranged along said edge in a pattern which permits any one of said elements to be assembled to any one of said elements along any one of said edges having a different pattern;

an auxiliary element, said auxiliary element having at least one rectilinear edge with a length along which said edge may be assembled with other elements, said edge including a symmetrical series of protrusions and intervals, and said auxiliary element being assemblable with each of the elements of said set; and the edge of a first element of said set including a first series of thirteen units width, said first series including two protrusions of which one protrusion is spaced from a first end of the length of the edge by an interval of one unit width and the other protrusion is spaced from the other end of said length by an interval of four units width, said two protrusions of said first series being spaced from each other by an interval of six units width, a second series on an edge of a second element including two protrusions of which one of said last named protrusions is spaced from a first end of the length of the edge by an interval of two units width and the other of said last named protrusions is spaced from the other end of said length by an interval of five units width, said two protrusions of said second series being separated from each other by an internal of four units width, the edge of said auxiliary element including a series of thirteen units width which includes five protrusions, two of said last named protrusions being positioned at respective ends of the length of the edge of said auxiliary element, a central one of said last named protrusions being positioned in the center of the length of the edge of said auxiliary element, and two intermediary ones of said last named protrusions being positioned each respectively at half the distance between one of the end protrusions and the central protrusion, the intervals between all of said last named protrusions being of two units width.

13. A set of elements as claimed in claim 12 in which the central protrusion has lateral faces, said central protrusion is symmetrical and includes identical hook means formed on lateral faces thereof.

14. A set of elements, each element comprising:

at least one rectilinear edge having a length along which the elements may be assembled with one another, each rectilinear edge including a plurality of identical protrusions formed thereon;

said protrusions being adapted to engage the protrusions on the edge of another element, said protrusions being of the same width and separated from each other along said rectilinear edge by intervals, each interval being formed of a space having at least one unit width, said unit width corresponding to the width of each protrusion, the length of said at least one rectilinear edge having a mid-point, said protrusions and said intervals being arranged along said edge disymmetrically with respect to said mid-point;

each rectilinear edge having a length of intervals greater than a total length of said protrusions on said edge such that at least three elements may be assembled to each other along one rectilinear edge, wherein the protrusions and intervals are arranged along said edge in a pattern which permits any one of said elements to be assembled to any one of said elements along any one of said edges having a different pattern;

said elements being one of an equilateral triangle and a square, wherein each of said triangle elements has the protrusions formed on the edges of said triangles, the protrusions and intervals defining a pattern, the pattern on each edge being different from the pattern formed on the other edges of the same triangle; and wherein the edges of said triangle elements each include a series of twenty-six units width, each of said series is divided into respective half-series, the first half-series of a first edge of one of said triangles includes a first protrusion spaced from a first end of the first half-series of the first edge by an interval of two units width and a second protrusion spaced from the first protrusion by an interval of seven units width and spaced from a second end of the first half-series of the first edge by an interval of two units width, the second half-series of the first edge including a third protrusion spaced from a first end of the second half-series of the first edge by an interval of one unit width and a fourth protrusion spaced from the third protrusion by an interval of one unit width and spaced from a second end of the second half-series of the first edge by an interval of nine units width, the first half-series of the second edge of the triangle including a fifth protrusion positioned at a first end of the first half-series of the second edge, a sixth protrusion spaced from the fifth protrusion by an interval of three units width, and a seventh protrusion positioned at a second end of the first half-series of the second edge, said fifth and sixth protrusions being spaced from each other by an interval of seven units width, the second half-series of the second edge including an eighth protrusion spaced from a first end of the second half-series of the second edge by an interval of seven units width and a ninth protrusion spaced from the eighth protrusion by an interval of one unit width and spaced from a second end of the second half-series of the second edge by an interval of three units width, the first half-series of a third edge of the triangle including a tenth protrusion spaced from a first end of the first half-series of the third edge by an interval of six units width and an eleventh protrusion spaced from the tenth protrusion by an interval of one unit width and spaced from a second edge of the first half-series of the third edge by an interval of four units width, the second half-series of the third edge including a twelfth protrusion spaced from a first end of the second half-series of the third edge by an interval of five units width and a thirteenth protrusion spaced from the twelfth protrusion by an interval of five units width and spaced from a second end of the second half-series of the third edge by an interval of one unit width; and wherein in each of said square elements the edges of said square elements each include a series of eighteen units width, each of said series being divided into respective half-series, the first half-series of a first edge of said squares including a first and a second end protrusion and a third intermediary protrusion spaced from one of the end protrusions by an interval of two units width and from the other end protrusion by an interval of four units width, the second half-series of the first edge including a fourth and a fifth protrusion each spaced from a respective end of the second half-series by an interval of one unit width, said fourth and fifth protrusions being separated from each other by an interval of five units width, the first half-series of a second edge of the square adjacent to the first edge including sixth and seventh protrusions of which one is spaced from one of the ends of the first half-series of the second edge by an interval of four units width and the other of the sixth and seventh protrusions is spaced from the other end of the first half-series of the second edge by an interval of two units width, said sixth and seventh protrusions being spaced from each other by an interval of one unit width, the second half-series of the second edge including an eighth and ninth protrusion of which one is spaced from one of the ends of the second half-series of the second edge by an interval of three units width and the other of the eighth and ninth protrusions is spaced from the other end of the second half-series of the second edge by an interval of two units width, the eighth and ninth protrusions being separated from each other by an interval of two units width, the third edge of the square opposed to the first edge including a series of protrusions and intervals spaced identical to and symmetrical with the first edge, the fourth edge of the square including a series of protrusions and intervals spaced identical to and symmetrical with the second edge.

* * * * *